US009417639B2

(12) United States Patent
Clark

(10) Patent No.: US 9,417,639 B2
(45) Date of Patent: Aug. 16, 2016

(54) NON-BRIDGING POSITION TAP CHANGER CONTROL AND METHOD OF OPERATION

(71) Applicant: Brandon & Clark, Inc., Lubbock, TX (US)

(72) Inventor: Scott W. Clark, Lubbock, TX (US)

(73) Assignee: BRANDON & CLARK, INC., Lubbock, TX (US)

( * ) Notice: Subject to any disclaimer, the term of this patent is extended or adjusted under 35 U.S.C. 154(b) by 164 days.

(21) Appl. No.: 14/223,001

(22) Filed: Mar. 24, 2014

(65) Prior Publication Data

US 2015/0268677 A1 Sep. 24, 2015

(51) Int. Cl.
*G05F 1/147* (2006.01)

(52) U.S. Cl.
CPC ..... *G05F 1/147* (2013.01)

(58) Field of Classification Search
CPC ..... G05F 1/147
See application file for complete search history.

(56) References Cited

U.S. PATENT DOCUMENTS

| | | | | |
|---|---|---|---|---|
| 4,081,741 | A * | 3/1978 | Palmer | H01H 9/0005 323/340 |
| 4,130,789 | A * | 12/1978 | Neumann | H01F 29/06 323/340 |
| 4,363,060 | A * | 12/1982 | Stich | H01F 29/04 323/262 |
| 2008/0074073 | A1 * | 3/2008 | Genkawa | 318/779 |

OTHER PUBLICATIONS

Clark et al., "Induction Motor Rotor Bar Damage Evaluation with Magnetic Field Analysis", Diagnostics for Electrical Machines, Power Electronics and Drives, 2015 IEEE 10th International Symposium, Sep. 1-4, 2015, pp. 39-43, IEEE, Guarda.

Rohner, "Demagnetization of large surface objects before welding", Maurer Magnetic AG—White paper, Apr. 2015, pp. 1-15, Maurer Magnetic AG, Switzerland.

Kang et al., "Experimental Evaluation of Low Voltage Off-Line Testing for Induction Motor Rotor Fault Diagnostics", Conference Paper in IEEE Transactions on Industry Applications, vol. 51, issue 2, pp. 127-136. May 2014.

Stone et al., "The Testing Tools—Preventing Failures in low and medium voltage motors", IEEE Industry Applications Magazine, Oct. 17, 2008, vol. 14, issue 6, pp. 48-53, IEEE Industry Applications Society.

(Continued)

*Primary Examiner* — Jue Zhang
(74) *Attorney, Agent, or Firm* — Jackson Walker LLP; Christopher J. Rourk

(57) ABSTRACT

A system for controlling voltage including a transformer having a terminal, a plurality of windings and a plurality of winding taps. A voltage monitor coupled to the terminal of the transformer and configured to generate voltage data representing a voltage appearing at the terminal of the transformer. A non-bridging tap changer controller coupled to the voltage monitor and configured to generate tap changer control data for changing a configuration of a tap changer in response to the voltage data. A tap changer motor coupled to the non-bridging tap changer controller and configured to move the tap changer in response to the tap changer control data.

20 Claims, 2 Drawing Sheets

(56) References Cited

OTHER PUBLICATIONS

Nau et al., "Methods to Evaluate the Quality of Stator and Rotor of Electric Motors", Diagnostics for Electrical Machines, Power Electronics and Drives, 2015 IEEE 10th International Symposium, Sep. 1-4, 2015, pp. 64-70, IEEE, Guarda.

Clark et al., "Squirrel Cage Induction Motor Cast Rotor Defect Detection with Magnetic Field Analysis", Electrical machines and Systems, 2015 IEEE 18th International Conference, Oct. 25-28, 2015, pp. 1019-1023, IEEE, Pattaya.

Clark, "A new method for testing rotor bars—Finding faults in the rotor bars of a squirrel cage induction motor may have gotten easier", Sep. 1, 2015 Electrical Apparatus, pp. 29-33.

Bishop, "Squirrel Cage Rotor Testing", EASA Convention 2003, Jun. 30, 2003, pp. 1-16, Electrical Apparatus Service Association, San Francisco, CA.

Clark, "Improvement of Step-Voltage Regulating Transformer Efficiency Through Tap Changer Control Modification", ECE 5343 Final Paper, Aug. 6, 2012, pp. 1-8, Texas Tech University.

* cited by examiner

NON-BRIDGING POSITION TAP CHANGER CONTROL AND METHOD OF OPERATION

TECHNICAL FIELD

The present invention relates to transformers, and more specifically to a tap changer control and method of operation that prevents a tap changer from stopping on a bridging position, in order to reduce operating losses.

BACKGROUND OF THE INVENTION

Transformers can be provided with windings that have winding taps and associated tap changers to allow the terminal voltage of the transformer to be increased or decreased a small amount, in response to voltage level changes caused by the load that the transformer is serving. The taps can be bridged with a reactor, to increase the resolution of the amount that the terminal voltage can be increased or decreased.

SUMMARY OF THE INVENTION

A system for controlling voltage comprising a transformer having a terminal, a plurality of windings and a plurality of winding taps. A voltage monitor coupled to the terminal of the transformer and configured to generate voltage data representing a voltage appearing at the terminal of the transformer. A non-bridging tap changer controller coupled to the voltage monitor and configured to generate tap changer control data for changing a configuration of a tap changer in response to the voltage data to prevent a tap setting that bridges two windings. A tap changer motor coupled to the non-bridging tap changer controller and configured to move the tap changer in response to the tap changer control data.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
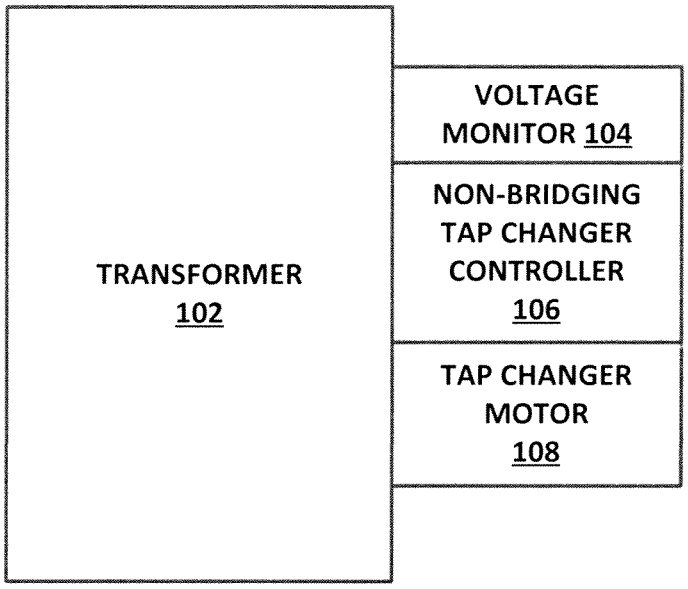
FIG. 1 is a diagram of a system for controlling a transformer with a non-bridging tap changer controller, in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a system 100 for controlling a transformer 100 with a non-bridging tap changer controller 106, in accordance with an exemplary embodiment of the present disclosure. System 100 includes transformer 102, voltage monitor 104, non-bridging tap changer controller 106 and tap changer motor 108, each of which can be implemented as discussed below or in other suitable manners.

Transformer 102 can be a pole-mounted distribution transformer with a predetermined number of bridging and non-bridging taps for voltage control, a pad-mounted distribution transformer with a predetermined number of bridging and non-bridging taps for voltage control or other suitable transformers. Transformer 102 can be a two phase transformer, a three phase transformer or can be used with other suitable phases, can have series windings, parallel windings or other suitable windings, and can have other suitable systems and components. Transformer 102 can include a type A step voltage regulator, a type B step voltage regulator or other suitable voltage regulators.

Voltage monitor 104 is coupled to the terminals of transformer 102, monitors the voltage at the terminals of transformer 102 and generates voltage data that reflects the terminal voltage. Voltage monitor 104 can be a discrete system, can be part of the voltage regulator, non-bridging tap changer 106, tap changer motor 108 or can be implemented in other suitable manners.

Non-bridging tap changer controller 106 is coupled to the terminals of transformer 100 and voltage monitor 104, and generates tap changer position control data based on the voltage monitor data and configuration data. In particular, non-bridging tap changer controller 106 can determine whether a tap setting is on a bridging or non-bridging position, and can change the tap setting in order to slightly increase or decrease the terminal voltage in order to avoid leaving the tap setting on a bridging position. Although transformers are provided with reactors and other components to reduce operating losses for tap settings on bridging positions, it has been empirically determined that the operating losses associated with tap settings on bridging positions are significantly greater than the operating losses associated with tap settings on non-bridging positions. As such, by controlling the positions of the taps to avoid bridging positions, a significant cost savings can be obtained. Non-bridging tap changer controller 106 can be implemented in hardware or a suitable combination of hardware and software, and can be one or more software systems operating on a suitable hardware platform.

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes a microcomputer or other suitable controller, memory devices, input-output devices, displays, data input devices such as keyboards or mice, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections.

Tap changer motor 108 is coupled to a tap changer that is in turn coupled to the taps of transformer 100 and to non-bridging tap changer controller 106, and changes the position of the taps of transformer 100 in response to the tap changer position control data generated by non-bridging tap changer controller 106. In one exemplary embodiment, tap changer motor 108 can be coupled to the tap changer through gears or other suitable mechanical conversion devices.

In operation, system 100 allows the tap settings of transformer 100 to be changed to increase or decrease the terminal voltage of transformer 100, and prevents the tap settings from being left on a bridging position. In this manner, operating losses for the transformer can be reduced.

Figure 2:
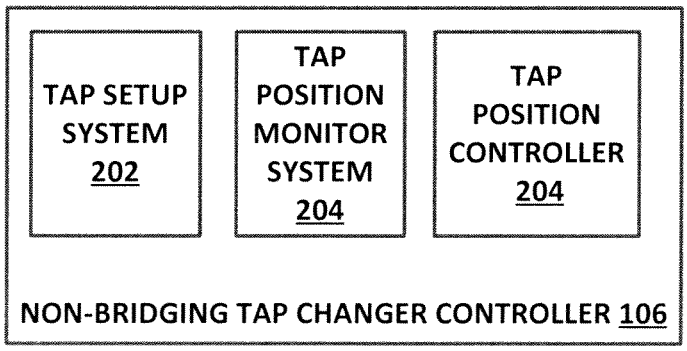
FIG. 2 is a diagram of a non-bridging tap changer controller, in accordance with an exemplary embodiment of the present disclosure.

FIG. 2 is a diagram of a system 200 for providing a non-bridging tap changer controller, in accordance with an exemplary embodiment of the present disclosure. System 200 includes non-bridging tap changer controller 106 and tap setup system 202, tap position monitor system 204 and tap position controller 206, each of which can be implemented in hardware or a suitable combination of hardware and software.

Tap setup system 202 stores configuration data for a transformer that includes the number of taps, whether a particular tap is a bridging tap or a non-bridging tap and other suitable data. Tap setup system 202 can be configured prior to installation, can include additional functionality to be able to determine the configuration data using one or more automated tests, can include a data interface to allow it to be controlled remotely, or can include other suitable systems, components and functionality.

Tap position monitor system 204 receives an initial tap position and tap change data from a tap changer motor or other suitable devices, and tracks the current tap setting position. In one exemplary embodiment, tap position monitor system 204 can perform automated tests to confirm tap position or can perform other suitable functions.

Tap position controller 206 receives terminal voltage data and determines whether the terminal voltage is above or below a predetermined terminal voltage setting. If the terminal voltage is above the predetermined setting, then tap position controller 206 determines a suitable tap setting to reduce the voltage, and if the terminal voltage is above the predetermined setting, then tap position controller 206 determines a suitable tap setting to increase the voltage. If changing the tap position up or down results in a voltage that exceeds a preferred voltage range, then tap position controller 206 can select the direction of change that results in a voltage that is closest to the desired voltage rang. Tap position controller 206 can generate individual tap movement control data that incrementally changes a tap position by one discrete step, can generate multiple tap movement control data that changes a tap position by two or more discrete steps, or can generate other suitable data.

In operation, system 200 allows a non-bridging tap changer controller to change the tap settings for a transformer so as to avoid leaving the tap settings at a bridging position. In the manner, the operating losses of the transformer can be reduced.

Figure 3:
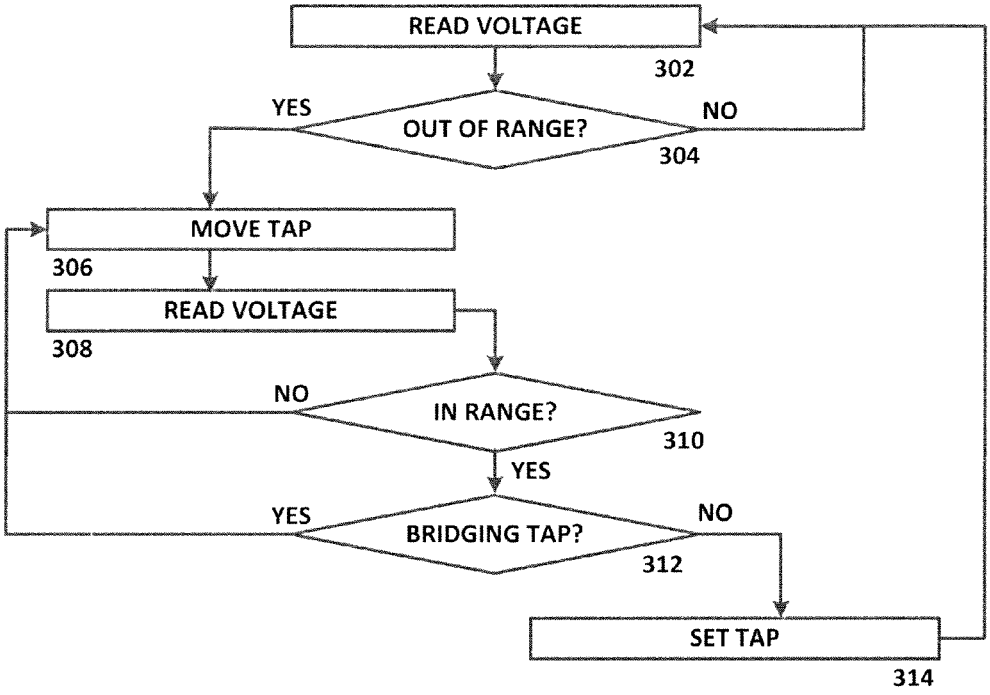
FIG. 3 is a diagram of an algorithm for controlling a non-bridging tap changer controller, in accordance with an exemplary embodiment of the present disclosure.

FIG. 3 is a diagram of an algorithm 300 for controlling a non-bridging tap changer controller, in accordance with an exemplary embodiment of the present disclosure. Algorithm 300 can be implemented in hardware or a suitable combination of hardware and software, and can be one or more algorithms operating on a suitable platform.

Algorithm 300 begins at 302, where a terminal voltage of a transformer is read. In one exemplary embodiment, the terminal voltage can be a two phase voltage, a three phase voltage or other suitable voltages. The algorithm then proceeds to 304.

At 304, it is determined whether the terminal voltage that was read is out of a predetermined range for the terminal voltage. In one exemplary embodiment, the predetermined range can be stored as a high value and a low value in a data memory, can be stored as a target value with a tolerance or variance, or can be stored in other suitable manners, and the terminal voltage reading can be compared to the stored data using suitable compare algorithm. If it is determined that the terminal voltage is not out of range, the algorithm returns to 302. Otherwise, the algorithm proceeds to 306.

At 306, the taps of the transformer are moved. In one exemplary embodiment, the sign of the difference between the voltage reading of the current terminal voltage and the predetermined range can be used to determine whether the voltage should be increased or decreased, and the taps can be moved one discrete position to increase or decrease the terminal voltage, such as by stepping a stepper motor by a predetermined number of steps to cause a mechanical tap changer mechanism to move a predetermined amount. In another exemplary embodiment, a target adjusted voltage can be calculated and the direction and number of tap position changes required to obtain that target voltage can be determined. Likewise, other suitable processes can also or alternatively be used to determine how much to change the taps and in which direction to change the taps. The algorithm then proceeds to 308.

At 308, the terminal voltage is read again, and the algorithm then proceeds to 310, where it is determined whether the terminal voltage is in range. If it is determined that the terminal voltage is not in range, the algorithm returns to 306, otherwise the algorithm proceeds to 312.

At 312, it is determined whether the current tap position is a bridging tap position. If the current tap position is a bridging tap position, then the algorithm returns to 306, where the tap is moved up or down. In one exemplary embodiment, the tap can be moved in a direction that results in the terminal voltage remaining within the predetermined range, or if there is no such position, then the tap can be moved to a position that is closest to the predetermined range. Likewise, other suitable processes can also or alternatively be used. If it is determined at 312 that the current tap position is a not bridging tap position, the algorithm proceeds to 314, where the tap is set, such as by actuating a tap position locking control, by removing power from the tap changer motor, or in other suitable manners. The algorithm then returns to 302.

In operation, algorithm 300 allows a tap changing controller to be operated so as to prevent the tap changing controller from setting a tap at a bridging position, in order to reduce operating losses. Although algorithm 300 is shown as a flow chart, a state diagram, an object diagram other suitable programming paradigms can be used to implement algorithm 300. Furthermore, although algorithm 300 is described in terms of changing the tap position and then determining what the terminal voltage is, the effect on the terminal voltage from a tap change can be modeled or estimated prior to actually moving the tap changer, so as to limit the amount of movement that the tap changer must perform, and corrective movements can be implemented for fine tuning.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for controlling voltage comprising a transformer having a terminal, a plurality of windings and a plurality of winding taps;

a voltage monitor coupled to the terminal of the transformer and configured to generate voltage data representing a voltage appearing at the terminal of the transformer;

a non-bridging tap changer controller coupled to the voltage monitor and configured to generate tap changer control data for changing a configuration of a tap changer in response to the voltage data to prevent a tap setting that bridges two windings; and a tap changer motor coupled to the non-bridging tap changer controller and configured to move the tap changer in response to the tap changer control data.

2. The system of claim 1 wherein the non-bridging tap changer controller further comprises a tap setup system configured to store data identifying a number of taps, data identifying taps that are bridging and data identifying taps that are non-bridging.

3. The system of claim 1 wherein the non-bridging tap changer controller further comprises a tap position monitor system configured to determine a position of the tap changer on the plurality of winding taps.

4. The system of claim 1 wherein the non-bridging tap changer controller further comprises a tap position controller configured to determine whether a tap position of a tap changer is a bridging position or a non-bridging position and to generate tap changer motor control data to move the tap changer to a non-bridging position.

5. The system of claim 1 wherein the voltage data representing the voltage appearing at the terminal of the transformer excludes differential voltages with adjacent transformers.

6. The system of claim 1 wherein the voltage data representing the voltage appearing at the terminal of the transformer is an internal voltage of the transformer.

7. A method for controlling voltage, comprising:

receiving a voltage signal;

determining with a processor or circuitry whether the voltage signal is outside of a predetermined voltage range;

changing a tap setting of a transformer with a tap changer device if the voltage signal is outside of the predetermined voltage range;

determining with the processor or the circuitry whether a new tap position is a bridging tap position or a non-bridging tap position; and changing the new tap position to an, adjacent tap position with the tap changer device if the new tap position is a bridging tap position.

8. The method of claim 7 wherein changing the new tap position to the adjacent tap position with the tap changer device if the new tap position is the bridging tap position comprises:

determining whether the adjacent tap position results in a terminal voltage that is outside of the predetermined voltage range; and changing the adjacent tap position to a second adjacent tap position.

9. The method of claim 7 wherein changing the new tap position to the adjacent tap position with the tap changer device if the new tap position is the bridging tap position comprises changing the new tap position to an adjacent tap position that increases a terminal voltage of a transformer.

10. The method of claim 7 wherein changing the new tap position to the adjacent tap position with the tap changer device if the new tap position is the bridging tap position comprises changing the new tap position to an adjacent tap position that decreases a terminal voltage of a transformer.

11. The method of claim 7 wherein changing the new tap position to the adjacent tap position with the tap changer device if the new tap position is the bridging tap position comprises:

prior to changing the new tap position to the adjacent tap position, determining whether the adjacent tap position will result in a voltage signal that is outside of the predetermined voltage range; and changing the adjacent tap position to a second adjacent tap position.

12. The method of claim 7 wherein changing the new tap position to the adjacent tap position with the tap changer device if the new tap position is the bridging tap position comprises changing the new tap position to a first adjacent tap position that decreases a terminal voltage of a transformer if a second adjacent tap position would increase the terminal voltage outside of the predetermined voltage range.

13. The method of claim 7 wherein changing the new tap position to the adjacent tap position with the tap changer device if the new tap position is the bridging tap position comprises changing the new tap position to a first adjacent tap position that increases a terminal voltage of a transformer if a second adjacent tap position would decrease the terminal voltage outside of the predetermined voltage range.

14. The method of claim 7 wherein changing the new tap position to the adjacent tap position with the tap changer device if the new tap position is the bridging tap position comprises:

determining a first amount that a first adjacent tap position would increase a terminal voltage of a transformer above a first voltage level;

determining a second amount that a second adjacent tap position would decrease a terminal voltage of a transformer below a second voltage level; and changing the new tap position to the first adjacent tap position if the first amount is less than the second amount.

15. The method of claim 7 wherein changing the new tap position to the adjacent tap position with the tap changer device if the new tap position is the bridging tap position comprises:

determining a first amount that a first adjacent tap position would increase a terminal voltage of a transformer above a first voltage level;

determining a second amount that a second adjacent tap position would decrease a terminal voltage of a transformer below a second voltage level; and changing the new tap position to the first adjacent tap position if the first amount is less than the second amount.

16. The method of claim 7 wherein receiving the voltage signal comprises receiving a terminal voltage of a transformer representing an internal voltage of the transformer and excluding differential voltages with other transformers.

17. A system for controlling voltage comprising a transformer having terminals, a plurality of windings and a plurality of winding taps;

a voltage monitor coupled to the terminal of the transformer and configured to generate voltage data representing a voltage appearing across the terminals of the transformer;

a non-bridging tap changer controller coupled to the voltage monitor and configured to generate tap changer control data for changing a configuration of a tap changer in response to the voltage data to prevent a tap setting that bridges two windings as a function of the voltage appearing across the terminals of the transformer and without a differential voltage between two transformers; and a tap changer motor coupled to the non-bridging tap changer controller and configured to move the tap changer in response to the tap changer control data.

18. The system of claim 17 wherein the non-bridging tap changer controller further comprises a tap setup system configured to store data identifying a number of taps, data identifying taps that are bridging and data identifying taps that are non-bridging.

19. The system of claim 17 wherein the non-bridging tap changer controller further comprises a tap position monitor system configured to determine a position of the tap changer on the plurality of winding taps.

20. The system of claim 17 wherein the non-bridging tap changer controller further comprises a tap position controller configured to determine whether a tap position of a tap changer is a bridging position or a non-bridging position and to generate tap changer motor control data to move the tap changer to a non-bridging position.

* * * * *